US005730651A

United States Patent [19]

Chen et al.

[11] Patent Number: 5,730,651

[45] Date of Patent: Mar. 24, 1998

[54] INDEPENDENT DIRECTIONAL-FLOW AIR DUCTS FOR LOW-PROFILE WINDOW FAN

[75] Inventors: Yung Chen, Clarendon Hills, Ill.; Eleobardo Moreno, St. John, Ind.

[73] Assignee: Lakewood Engineering and Manufacturing Co., Chicago, Ill.

[21] Appl. No.: 700,561

[22] Filed: Aug. 8, 1996

[51] Int. Cl.[6] ..... F24F 7/013

[52] U.S. Cl. ..... 454/205; 454/210

[58] Field of Search ..... 454/200, 205, 454/210

[56] References Cited

U.S. PATENT DOCUMENTS

| | | | |
|---|---|---|---|
| D. 133,291 | 8/1942 | Powers . | |
| D. 219,588 | 12/1970 | Laupot . | |
| D. 266,786 | 11/1982 | Schmidt . | |
| D. 345,011 | 3/1994 | O'Grady . | |
| 1,014,321 | 1/1912 | Minor . | |
| 2,061,535 | 11/1936 | Davies . | |
| 2,275,564 | 3/1942 | Shawhan et al. . | |
| 2,337,325 | 12/1943 | Hach et al. | 454/205 |
| 2,407,858 | 9/1946 | Whitefield . | |
| 2,456,391 | 12/1948 | Davies | 454/205 |
| 2,620,126 | 12/1952 | Lyne . | |
| 2,733,002 | 1/1956 | Hack . | |
| 2,787,207 | 4/1957 | Moore . | |
| 2,805,820 | 9/1957 | Evarts . | |
| 3,421,428 | 1/1969 | Baumann et al. . | |
| 3,986,794 | 10/1976 | Korn . | |
| 4,773,310 | 9/1988 | Corwin . | |
| 5,190,496 | 3/1993 | Shih-Chin . | |
| 5,334,091 | 8/1994 | Shih-Chin . | |
| 5,382,136 | 1/1995 | Wang . | |

OTHER PUBLICATIONS

Revcor Inc. Engineering Bulletin.

*Primary Examiner*—Harold Joyce

*Attorney, Agent, or Firm*—Wallenstein & Wagner, Ltd.

[57] ABSTRACT

A window fan capable of permitting the flow of air in one of at least three different patterns, including intake, exhaust and a simultaneous exchange of air. The fan includes a housing, having front section including a forward inner wall, and a back section having a rearward outer wall. The housing further includes a pair of opposed projecting side walls having an elongated opening. Positioned within the elongated opening within the side walls are a pair of side panel assemblies comprised of expandable, accordion-style side panels secured within a side panel frame. Directional air flow through the housing is effectuated through the use of at least one impeller having a plurality of blades, located within the housing, in combination with a pair of rotatable C-shaped ducts.

19 Claims, 5 Drawing Sheets

INDEPENDENT DIRECTIONAL-FLOW AIR DUCTS FOR LOW-PROFILE WINDOW FAN

TECHNICAL FIELD

This invention relates to a fan, more particularly, to a window fan capable of permitting the flow of air in one of at least three different patterns, including intake of fresh air, exhaust of stale air, and a simultaneous exchange of fresh air and stale air.

BACKGROUND OF THE INVENTION

Electric window fans are not a new alternative to contemporary air conditioners. Window fans traditionally offer low cost and simplicity, both in construction and operation. Therefore, for nearly 100 years, electric fans have retained their popularity, and are often an easy-to-operate, cost-efficient alternative to conventional air conditioning units.

Consumers consider window fans to avoid the expense of installation and repair of air conditioners. Many consumers also dislike the often uncomfortable low settings of air conditioning units, and the absence of fresh air associated with air conditioned areas. To be a competitive alternative to air conditioning units, it has become necessary for electric fans, and specifically window fans, to offer a greater number of features, while maintaining reliability and low cost, to meet the demands of consumers.

Many electric fans meeting the criteria described are the traditional propeller style or blade fans. Blade fans are typically easy to operate and position in many areas. However, many fans of this simple nature lack some of the features consumers prefer, such as temperature adjustment, found in air conditioning units. Alternatively, in addition to performing the conventional features of moving air, manufactures have proposed systems which operate additionally as ventilators, i.e., supplying fresh air and exhausting stale air, preferably simultaneously, and increasing air cyclization efficiency. Such ventilation features are important where room air is contaminated by smoke or food odors. Further, the use of constant fresh air through a window fan or ventilator avoids the cold temperature problems of air conditioner units. The drawback with adding such enhancements to fans, in an effort to meet consumer demands, is that the result is often a technically complicated and costly unit, defeating the purpose of a simple, low cost alternative to air conditioner units.

Consequently, there is a need for a lightweight, portable, uncomplicated window fan, adjustable for any size window, having a single motor. A single motor propelling at least one, and preferably two centrifugal fans, provides cost and energy efficiency advantages over many prior art fans requiring two motors. There is also a need for a window fan having the capability of simultaneous air flow from an exterior space to an interior space and vice versa, using minimal, uncomplicated means for adjusting the air flow, and for instantly changing the pattern of the air flow. Finally, there is a need for a fan having the capability of temperature regulation to assist in mediating the ambient temperature of the room the unit is serving. The unit maintains the ambient temperature without the need for a recirculating filter unit, while continuing to provide fresh air, rather than recirculated air, through the use of a thermostat. The thermostat regulates the flow of air by turning the unit on and off as needed, without intervention from the consumer. The present invention combines these advantages in a single, low cost, simple unit.

SUMMARY OF THE INVENTION

In accordance with the invention a window fan comprising a housing adapted for mounting within a window, the housing having a front section and a back section. Air flow openings are formed within the front section and the back section, and are adapted for permitting the flow of air through the housing between an interior space and an exterior space. At least one impeller having a plurality of blades is positioned within the housing and adapted for moving air through the air flow openings. Directional means cooperate with the impeller for controlling the pattern of air through the air flow openings such that the air may flow in a forward direction from the back section to the front section, or may flow in a reverse direction from the front section toward the back section. A single motor is provided for driving the impeller.

Other advantages and aspects of the present invention will become apparent upon reading the following description of the drawings and detailed description of the invention.

DETAILED DESCRIPTION

Figure 1:
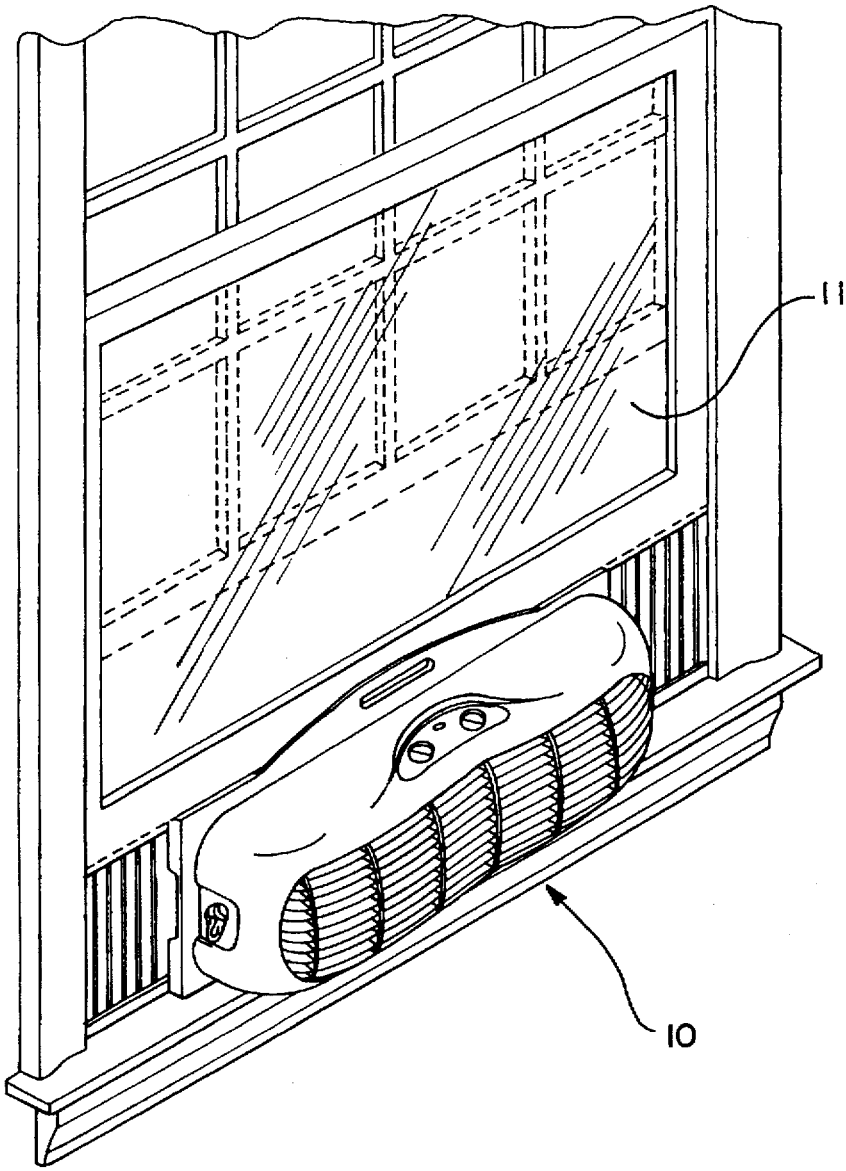
FIG. 1 is a perspective view of a window fan in use in accordance with the invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

A fan 10, and preferably a fan for installation in an open window, provides a low-cost, efficient alternative to an air conditioning unit. The fan 10 comprises a housing 12, air flow openings 14, at least one impeller 16 positioned within the housing, at least one directional means 18 cooperating with the impeller to control the flow of air through the housing, and a motor 20 for propelling the impeller.

Figure 2:
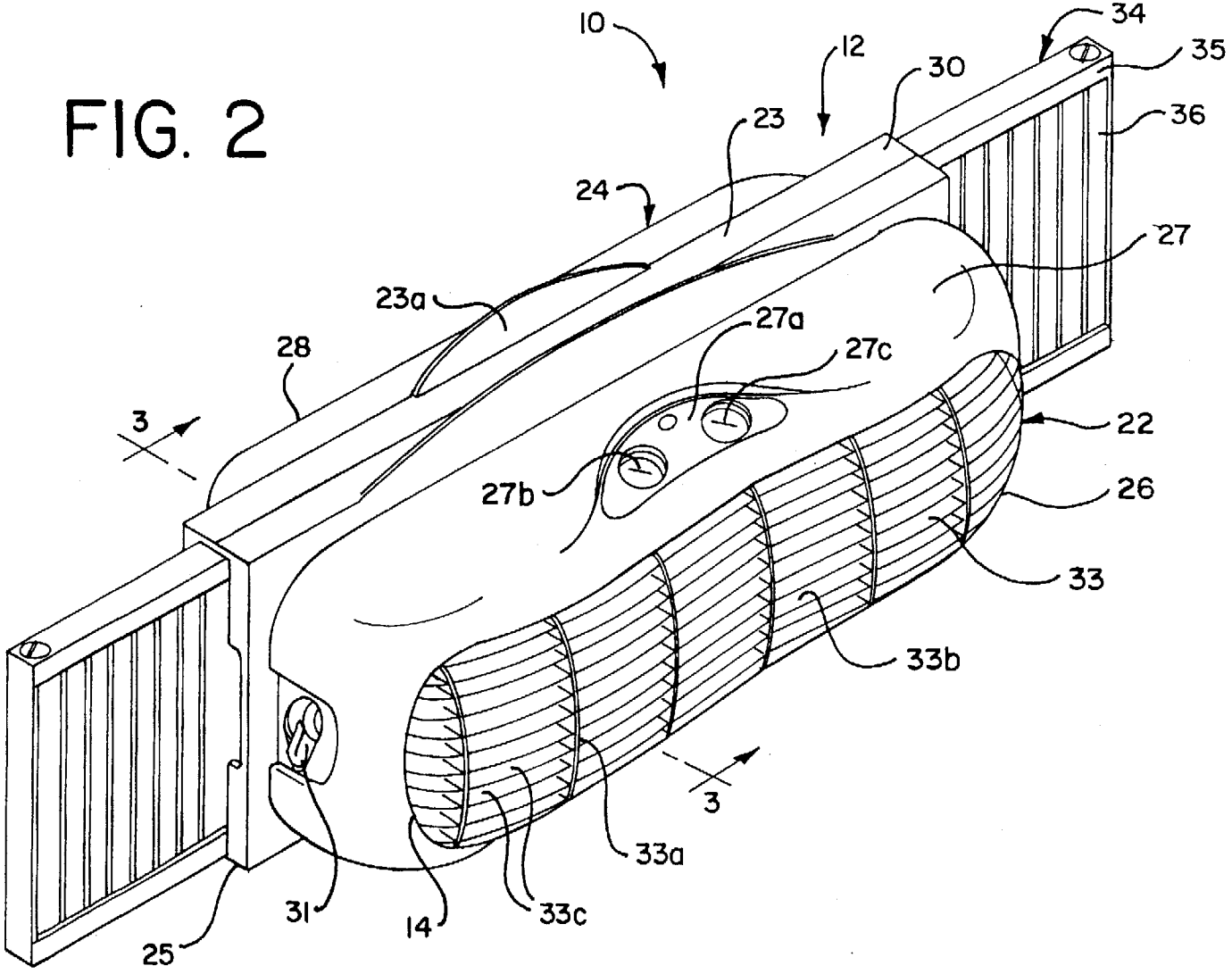
FIG. 2 is a perspective view of the window fan made in accordance with the invention.

As shown in FIGS. 1 and 2, the housing 12 can be any shape, but is preferably substantially rectangular, for fitting easily into an open window 11 as shown, or in another opening associated with the space to be ventilated. The housing 12 has a low profile shape, providing minimal obstruction of the view from the window 11 in which the fan is placed. The housing 12, preferably constructed of a molded plastic, is formed essentially of two pieces, a front section 22 and a back section 24. The front section 22 includes a front wall 26, while the back section 24 includes a substantially flat back wall 28. While it is preferred that the back wall 28 is flat, to minimize projection of the fan to the outside, the front wall 26 may have a substantially flat shape, or can be curved or rounded to give a more ornamental appearance to the fan 10. When the front section 22 and the back section 24 are connected together by any conventional means such as screws and snap-in mechanisms, the edges of the sections form a substantially flat top 23, bottom 25 and a pair of sideways projecting side walls 30.

Air flow openings 14 are defined by both the front section 22 front wall 26, and the back section 24 back wall 28. Both the front wall 26 and the back wall 28 are comprised of a longitudinally positioned grill 33. The generally rectangular, flat grill 33 is comprised of latticed vertical 33*a* and horizontal ribs 33*b*. Generally rectangular shaped apertures 33*c* through which air may pass are formed by the ribs 33*a*, 33*b* of the grill. The size of the apertures 33*c* is determined by the cross-sectional area of the grill 33, the number and placement of ribs 33*a*, 33*b*, and further depends upon the air flow to be handled by the fan, as is known in the art. The grill 33 is typical of window fans and is useful for keeping debris out of the way of the impeller 16 and motor 20 located within the housing 12. The air flow openings 14 define an area within the housing 12 through which air can flow in one of at least three different patterns, as will be described.

Figure 3:
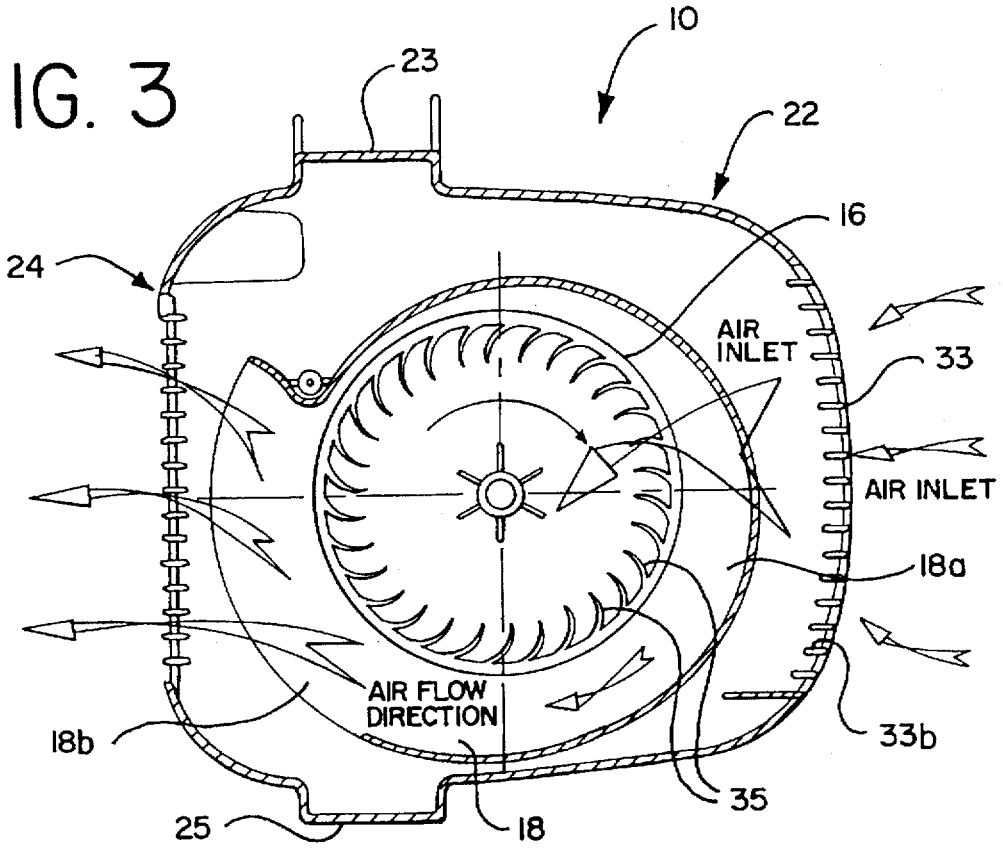
FIG. 3 is an enlarged side view of the directional means of the window fan of FIG. 1 showing the pattern of the air flow.

As shown in FIG. 3, positioned within the housing 12 behind the grill 33 defining the front wall 26, is at least one to a multiple number of impellers 16 used to project air flow through the fan 10. Preferably two, standard-size, squirrel cage impellers 16 are used. The impellers 16, as their name implies, each have a generally circular or oblong shape, and include a plurality of blades 35 spanning the width of, and about the entire circumference of the impeller. Also, preferably, the shape of the blades 35 is forward-curved, meaning the blades are inclined in the direction of the rotation. Impellers of the type useful in the invention are available from Revcor, Inc. in Carpentersville, Ill.

Many prior art fans use a propeller or multiblade fan unit instead of squirrel cage impellers. Squirrel cage impellers 16 are preferred for use in the present invention because of the positive pressure air flow they generate over that of the propeller-type blade. Positive pressure air flow is preferred for use in conjunction with the directional means 18 to provide the most effective air flow pattern possible.

As will be appreciated by those skilled in the art, the number, size and circumference of the impellers 16, and the configuration and number of blades 35 on the impellers, depends upon the air flow desired and the characteristics of the motor 20. If two impellers 16 are used, they are preferably mounted asymmetrically across the inside of the housing 12, on a double shaft or a long shaft 37, on either side of the motor 20. Typically, the motor 20 is centered within the housing 12, but optionally the motor could be positioned on one side or the other of the housing, for instance, if only one squirrel cage impeller 16 is used.

In cooperation with the impellers 16, there is provided a directional means 18 for controlling the pattern of air through the housing 12. Directional means are in the form of at least one, and preferably two, industry standard, generally C-shaped ducts 18. Ducts 18 of the type useful in the invention are also available from Revcor, Inc.

Figure 4:
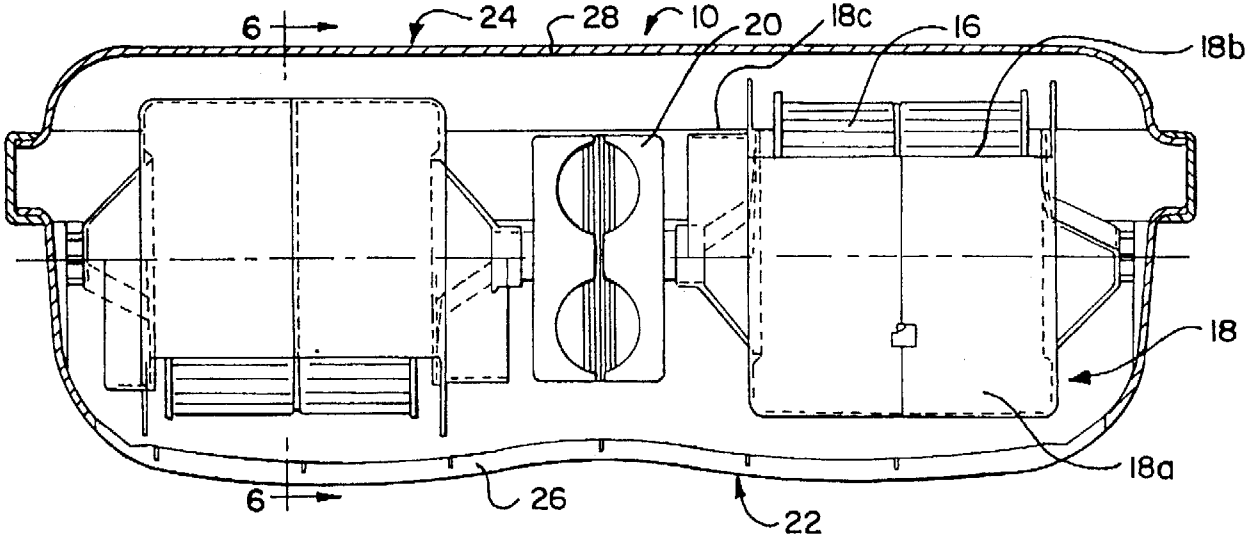
FIG. 4 is a top cut-away view of the window fan of FIG. 1.

It should be understood to those skilled in the art, that while two ducts 18 may be preferred, any number of ducts may be useful in the invention. The ducts 18 are defined by a semi-circular, solid sidewall 18*a* and an elongated opening 18*b*, having a width proportional to approximately the same size as the sidewall. Adjacent to, and on either side of the opening 18*b* are a pair of side flanges 18*c* (FIG. 4). The direction the sidewall 18*a* and the opening 18*b* of the ducts 18 are facing, in cooperation with the side flanges 18*c*, will determine the pattern of the air flow through the fan 10. Levers 31, positioned on either side of the housing 12 are connected to a plurality of spokes or radial arms 17 associated with each duct, and serve as means for adjusting the position of the ducts 18. When the lever 31 is switched between two directions, an upright position and a downward position, the ducts 18 rotate individually forward and backwards about each of the impellers 16. Preferably one lever 31 is associated with each individual duct 18.

In an another embodiment of the invention, a single lever 31, positioned on the side of the housing 12, can be used to rotate at least one duct 18, and preferably more than one duct. For example, if two ducts 18 are used, the lever 31 can be rotated in a clockwise direction, rotating both ducts simultaneously, positioning the first duct into the desired position. The lever 31 can then be rotated counterclockwise, rotating only the second duct, while the first duct remains stationary in the position previously chosen through the clockwise rotation of the lever. In this manner, the ducts 18 can be rotated simultaneously and then independently into a desired position for directing air flow through the fan 10. The ducts 18 are then locked into position through the use of a pair of teeth (not shown) positioned approximately 180° apart on either side of the duct, which lock into recesses (not shown) on the motor bracket.

Figure 3A:
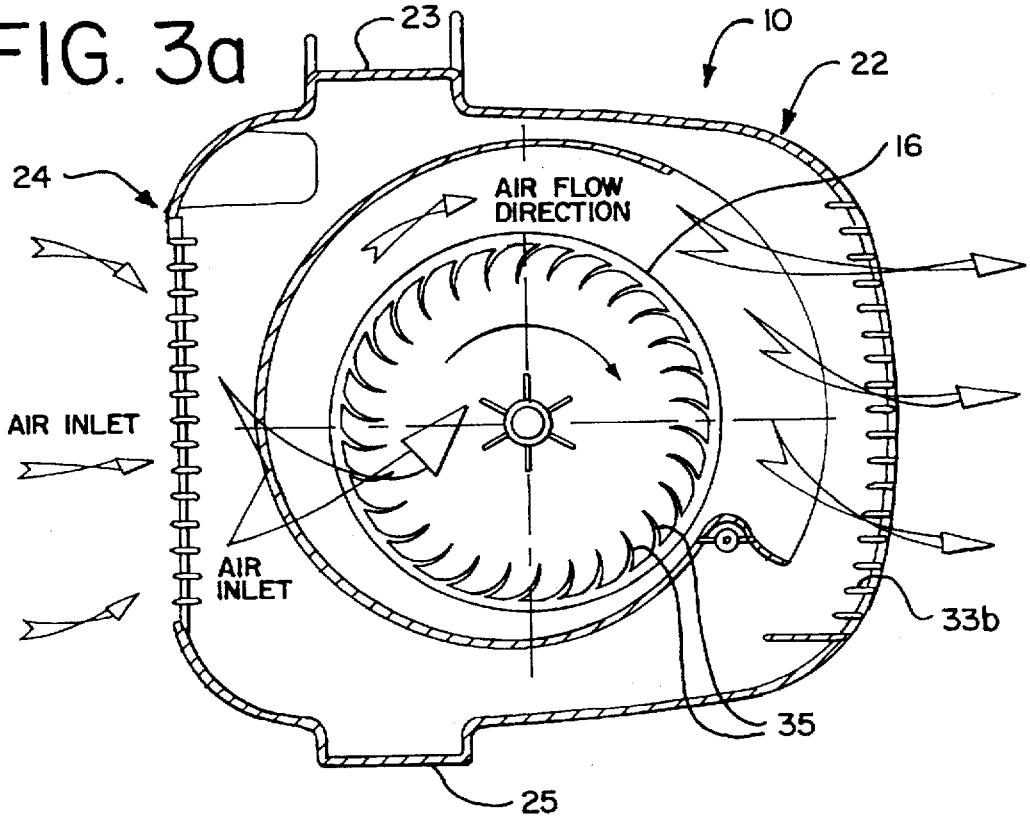
FIG. 3*a* is an enlarged side view of the directional means of the window fan showing the air flow in the direction opposite from FIG. 2.
Figure 5:
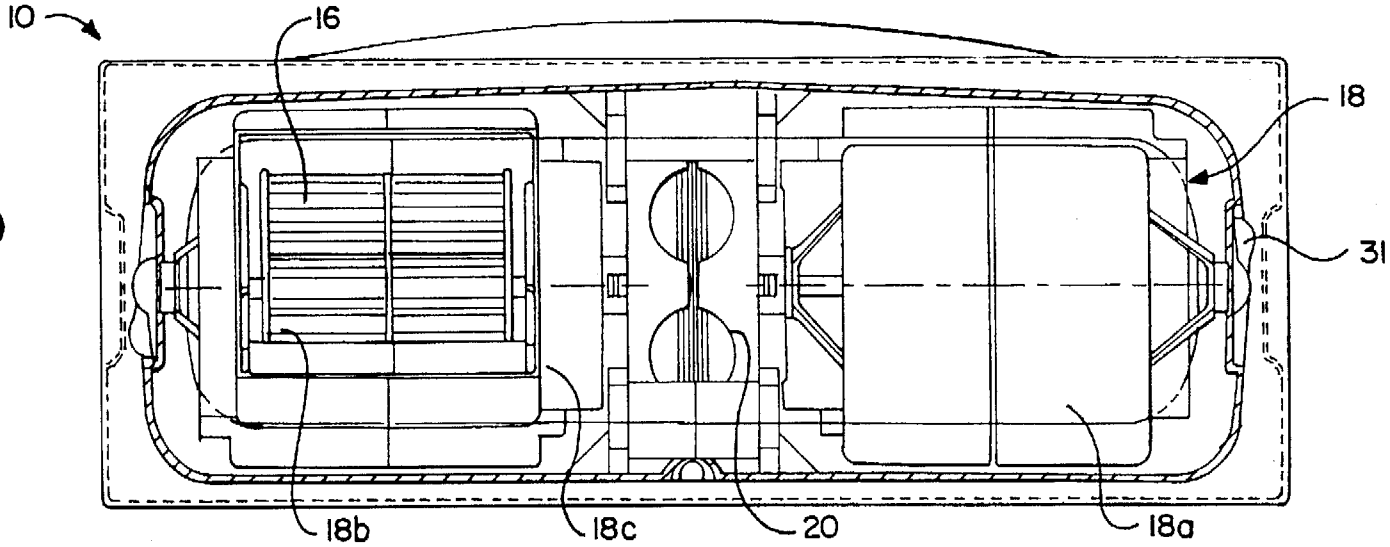
FIG. 5 is front cut-away view of the window fan of FIG. 1.

As shown in FIGS. 3, 3*a* and 5, rotating the ducts 18 changes the flow of air between at least three different patterns through the housing 12, due to the cooperation between the sidewall 18*a*, the opening 18*b*, and side flanges 18*c* on either side of the opening. For example, in a first direction, where it is desired for air to flow in a forward direction from the back section 24 to the front section 22, and therefore into an interior space or room, both ducts 18 are positioned such that the sidewall 18*a* of each duct is facing toward the back wall 28, and the opening 18*b* of each duct is facing toward the front wall 26. In this position, the side flanges 18*c* prevent air from flowing directly through the air flow openings, from the back section 24 to the front section 22, but instead forces the air around the sidewall 18*a* and into the impeller 16 where the air is then projected into the room. In a second flow pattern, where it is desired to exhaust air from an interior space, such that air flows from the front section 22 to the back section 24, both ducts 18 are rotated such that the opening 18*b* is facing rearwardly, and the sidewall 18*a* is facing forward. Again, the air flow is forced around the sidewall 18*a* and into the impeller 16 for exhausting to the outside. Finally, by rotating the ducts 18 in opposite directions, specifically so that the opening 18*b* of one duct faces the front wall 26, and the sidewall 18*a* of the second duct also faces the front wall, air flow can be directed to intake and exhaust simultaneously.

The air flow rate through the impeller 16 and its associated duct 18 varies depending upon the positioning of the duct in relation to the impeller. Specifically, the air flow rate can depend upon the diffuser angle, which is the angle between the periphery of the impeller 16 and the inside surface of the duct 18. As shown in FIGS. 3 and 3*a*, the diffuser angle between the periphery of the impeller 16 and the inside surface of the duct 18 increases from one end of the duct around to the other, and typically in the direction of the air flow through the duct. Increases in the diffuser angle cause an increase in the air flow rate. Diffuser angles useful in the invention range between 4° and 12°, with an angle of 6.5° being preferred.

The top 23 of the housing 12 is a substantially flat surface extending the entire length of the fan 10 and forming the top of the side walls 30 (FIG. 2). When the fan 10 is positioned within an open window, the top 23 of the housing 12 contacts the bottom edge of the window, essentially forming a barrier to the elements. Centered within the top 23 of the housing 12, is a small, rearwardly facing cutout portion forming a handle 23*a*. The handle 23*a* is large enough to accommodate three to four fingers for ease in moving the fan 10 from one place to another.

The bottom 25 of the housing 12 is likewise a flat surface for positioning the fan 10 levelly on the sill of an open window, or any other surface on which the fan is placed. Preferably, the fan 10 is placed horizontally in an open window. The bottom 25 of the housing 12 includes a U-shaped channel (not shown) which opens toward the front wall 26, for accommodating an electrical cord used to plug the fan 10 into a standard electrical outlet. The U-shaped channel shelters the electrical cord from the constant weight of the fan 10 while the fan is positioned on the window sill, or other surface.

When properly positioned within an open window, the front wall 26 of the front section 22 projects into the interior of the room or space to be served by the fan 10. As shown in FIG. 2, the top portion 27 of the front wall 26 slopes slightly downward from the top 23 of the housing, forming a shelf for a control panel 27*a*. The control panel 27*a* includes dials for thermostat regulation 27*b* and impeller speed 27*c*. The thermostat dial 27*b* allows the consumer to set the fan 10 to an estimated desired temperature such that when the area being serviced by the fan reaches a certain temperature, the fan will either start or shut off, based on the setting. This automatic temperature regulation provides for independent operation of the fan 10 even when a person is not present in the room, or during the night when sleeping. The impeller speed dial 27*c* provides for manual adjustment of speed of the impellers 16.

The back wall 28 of the back section 24 communicates with the exterior environment for intake and exhaust of air flow. The back wall 28 is preferably substantially flat in shape such that the fan 10 can be positioned within a window opening without the need for removing the outer screen from the window. The back wall 28 in conjunction with the front wall 26, define the air flow openings 14. The back wall 28 is also covered by the substantially rectangular flat grill 33, as previously described.

One advantage of the present invention is the use of a single motor 20 for operating the impellers 16 to create air flow in potentially three different directions. Many prior art fans require a motor for each fan unit, to accomplish what the present invention accomplishes with a single motor. Further, the air flow patterns can be changed without reversing the motor 20, which is more efficient and convenient than units requiring a reversal of the motor to change the air flow pattern. A unidirectional motor, having minimal energy requirements is preferred. Motors of the type useful in the present invention are available from MacMillan Electrical in Milwaukee, Wis.

As shown in FIG. 2, extending outwardly from either side of the housing 12, is a pair of side walls 30. The top and bottom of the side walls 30 are formed from the top 23 and bottom 25 of the housing 12, and specifically from joining opposite edges of the front section 22 and the back section 24. Within each one of the side walls 30, and extending vertically between opposite ends thereof, is an narrow opening 31*a*, approximately 8¾ inches in depth from the end of the side walls, and approximately ¾ inches in width.

Accommodated within the narrow opening 31*a* is a pair of expandable side panel assemblies 34. The side panel assemblies 34 are movable between a recessed position for storing completely within the narrow opening 31*a*, and a projecting position outside of the narrow opening as shown in FIG. 2. The side panel assemblies 34 are useful for blocking the position of the window not covered by the fan 10, providing privacy.

Each of the side panel assemblies 34 are defined by a generally U-shaped, extendable side panel frame 35 framing an expandable panel 36. Specifically, disposed within the inner surface 35*a* of each frame 35 is a single, expandable, accordion-style panel 36, which expands when the side panel assembly 34 is in an extended position, and compresses together when the side panel assembly is in a stored, recessed position. The compressibility of the accordion-style panel 36 allows for storage of the side panel assembly 34 within the relatively shallow, narrow opening 31*a*. The movement of the side panel frame 35 and accordion-style panels 36 is a similar concept to the movement of curtains on a curtain rod. The accordion-style panels 36 of the side panel assemblies 34 allow for customized positioning of the fan 10 within window openings having a variety of widths. The side panel assemblies 34, including the frame 35 and expandable panels 36, are constructed from any suitable plastic known in the art.

Figure 6:
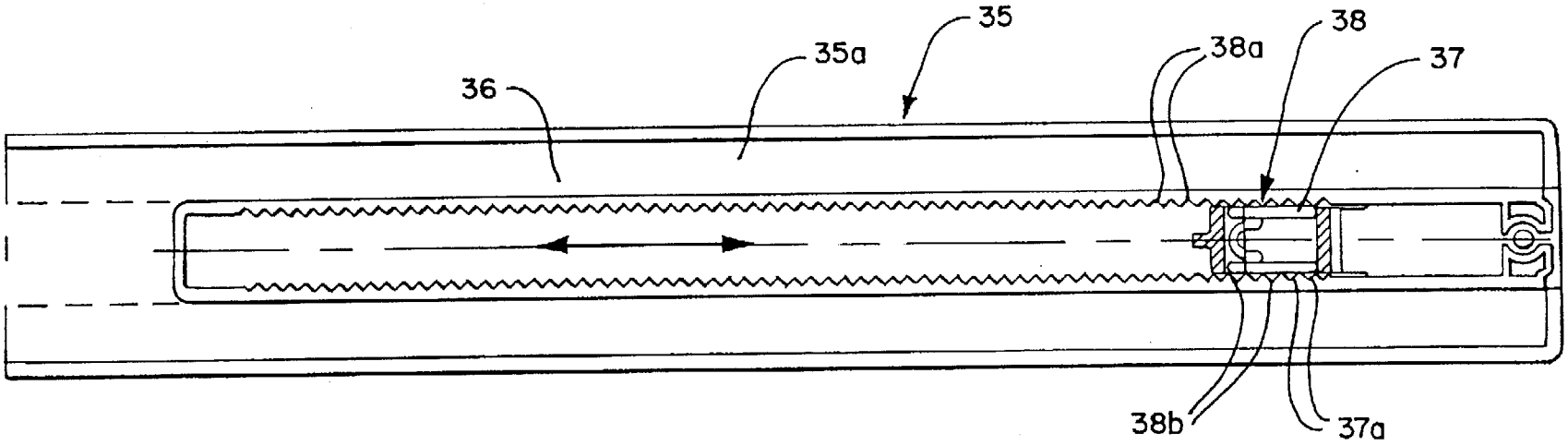
FIG. 6 is a top cut-away view of the side panel frame showing the engagement assembly.

As shown in FIG. 6, located within the inner surface 35*a* of the side panel frame 35 is an engagement assembly 38. The engagement assembly 38 includes teeth 38*a* and corresponding recesses 38*b* on the two side inner surfaces of the frame 35, and a C-shaped clip 37 with a pair of projections 37*a* on each upper side of the clip, which engage the teeth 38*a* by fitting within the recesses 38*b* of each side of the frame 35. The engagement assembly 38 does not actually lock the side panel assemblies 34; that is, it does not prevent movement of the side panel assemblies 34 into either a retracted or expanded position. Rather, each side panel assembly 34 may be forced into an extended position or a retracted position, simply by pulling or pushing, respectively, on the side panel frame 35. The pulling or pushing force causes the C-shaped clip 37 to deform thereby causing the projections 37*a* to disengage from the recesses 38*b* on the frame 35, allowing the side panel assembly 34 to move into a retracted or expanded position.

The side panel assemblies 34 are useful in positioning the fan 10 within an open window, and for blocking the portion of the window not covered by the fan. Preferably, the side panel assemblies 34 should have the ability to hold slightly more securely in the expanded position than in the retracted position. Therefore, in an effort to facilitate movement of the side panel assemblies 34 more easily in the extended direction, but require more force to move in the retracted direction, the teeth 38*a* located within the inner surface of the frame 35, are constructed with sides of differing degrees of slopes. Each of the teeth 38*a* has one side formed at an angle of about 40°, and the opposing side at an angle of about 60°. This design permits the projections 37*a* of the C-shaped clip 37, and therefore the side panel assemblies 34, to travel more easily in one direction than in the opposite direction, i.e. more easily in the expanded direction than in the retracted direction. Specifically, the force required to move the side panel assemblies 34 to an extended open position is approximately 5 pounds, which is less than the force required to move the side panel assemblies in the opposite, retracted position, approximately 8–10 pounds. The side panel assemblies 34 are never truly "locked," as found in many prior art devices.

While the specific embodiments have been illustrated and described, numerous modifications come to mind without significantly departing from the spirit of the invention and the scope of protection is only limited by the scope of the accompanying Claims.

We claim:

1. A fan comprising:

(a) a housing adapted for mounting within a window, the housing having a front section and a back section and having an electric motor mounted in a fixed position therein;

(b) air flow openings formed within the front section and the back section, adapted for permitting the flow of air through the housing;

(c) at least one impeller positioned within the housing and adapted to be driven by said motor for moving air through the air flow opening;

(d) directional means cooperating with the impeller for directing the flow of air through the air flow openings, said directional means being a duct surrounding said at least one impeller and being rotatably mounted relative to the motor, the ducts being adapted to direct air flow such that the air may flow in a forward direction from the back section toward the front section, or may flow in a reverse direction from the front section toward the back section.

2. The fan of claim 1 wherein the impeller further includes a plurality of blades.

3. The fan of claim 2 wherein the blades are forward-curved in a rotational direction of the impeller.

4. The fan of claim 1 wherein the directional means is adapted to direct air flow simultaneously in the forward direction and the reverse direction.

5. The fan of claim 1 wherein the housing is substantially rectangular in shape and the front section includes a front wall, and the back section includes a back wall.

6. The fan of claim 1 wherein the housing having projecting side walls of expandable side panel assemblies.

7. The fan of claim 6 wherein the projecting side walls further include an engagement means providing resistance to the side panel assemblies for expanding out or retracting into a desired position.

8. The fan of claim 1 wherein the air flow openings include a grill structure of latticed vertical and horizontal ribs.

9. The fan of claim 1 wherein a first and a second impeller are positioned within the housing and the directional means includes a first duct adjacent to and at least partially covering the first impeller, and a second duct adjacent to and at least partially covering the second impeller.

10. The fan of claim 9 wherein the first and second ducts are independently rotatable about the first and second impellers through manipulation of at least one lever positioned adjacent to one side of the housing.

11. The fan of claim 9 wherein the first duct and the second duct include a substantially circular sidewall and an opening in the sidewall such that each duct sidewall is substantially C-shaped; each duct having at least one substantially open end which permits the flow of air from within the housing toward the impellers.

12. A window fan comprising:

(a) a housing having a front wall and a back wall and adapted for mounting within a window;

(b) air flow openings formed within the front wall and the back wall adapted for permitting the flow of air through the housing;

(c) a single motor mounted in fixed position within the housing;

(d) at least a first and a second impeller driven by the single motor, positioned within the housing and adapted for moving air through the air flow openings;

(e) directional means cooperating with the impellers, said directional means being a first and second C-shaped duct, said first duct surrounding the first impeller, said second duct surrounding the second impeller, each duct being independently rotatable relative to said motor and adapted to provide a means for controlling the pattern of air flow through the air flow openings such that the air may be directed to flow in a forward direction from a back section toward a front section, or directed to flow in a reverse direction from the front section to the back section, or directed to flow simultaneously in the forward and the reverse direction.

13. The window fan of claim 12 wherein the first and the second impellers further include a plurality of circumferentially-positioned horizontal blades.

14. The window fan of claim 12 wherein the direction means further includes at least one lever positioned adjacent to one side of the housing.

15. The window fan of claim 14 wherein when the lever is rotated in a first direction, the ducts rotate simultaneously, and when the lever is rotated in a second direction, the ducts rotate independently.

16. The window fan of claim 12 wherein the motor is positioned between the first and the second impellers.

17. A fan having a housing with a front opening and a back opening and an electric motor fixedly mounted within the housing, comprising:

a first and second impeller connected to the electric motor, the impellers being rotationally driven by said motor;

a first and a second duct, each said duct having a substantially circular sidewall with an opening and being independently rotatable relative to the motor to a forward position wherein the opening is positioned toward the housing front opening, and to a reverse position wherein the opening is positioned toward the housing back opening, said first duct being rotatably mounted and surrounding the first impeller and said second duct being rotatably mounted and surrounding the second impeller;

a first lever integrally attached to said first duct and being rotatable between a downward and an upright position to rotate said first duct relative to the motor between said forward and reverse positions;

a second lever integrally attached to said second duct and being rotatable between a downward position and an upright position to rotate said second duct relative to the motor between said forward and reverse positions.

18. The fan of claim 17 wherein each duct having a plurality of side flanges, each flange extending from a side of the duct opening toward the fan housing and being adapted to prevent air flow through the housing and to direct air around the duct sidewall.

19. The fan of claim 18 wherein each said duct having an inner surface with a diffuser angle in the range of 4° to 12°.

* * * * *